US005511955A

United States Patent [19]

Brown et al.

[11] Patent Number: 5,511,955

[45] Date of Patent: Apr. 30, 1996

[54] CRYOGENIC PUMP

[75] Inventors: Bruce G. Brown, Corona, Calif.; Robert E. Crowl, Corpus Christi, Tex.; Phillip J. Westermann, El Toro, Calif.

[73] Assignee: Cryogenic Group, Inc., Murrieta, Calif.

[21] Appl. No.: 384,970

[22] Filed: Feb. 7, 1995

[51] Int. Cl.[6] ..... F04B 15/08

[52] U.S. Cl. ..... 417/259; 417/901; 62/50.7

[58] Field of Search ..... 417/901, 259; 62/50.7

[56] References Cited

U.S. PATENT DOCUMENTS

| | | | |
|---|---|---|---|
| 2,888,879 | 6/1959 | Gaarden | 417/901 X |
| 3,016,717 | 1/1962 | Gottzman | 417/901 X |
| 3,220,202 | 11/1965 | Gottzman | 417/901 X |
| 4,239,460 | 12/1980 | Gölz . | |
| 4,576,557 | 3/1986 | Peuzner | 417/901 X |
| 4,639,197 | 1/1987 | Tornard | 417/259 |
| 5,188,519 | 2/1993 | Spulgis . | |

*Primary Examiner*—Richard E. Gluck
*Attorney, Agent, or Firm*—Harold L. Jackson

[57] ABSTRACT

A cryogenic pump capable of operating with a sub-zero net positive suction head includes a reciprocating piston positioned in a cylindrical housing for dividing the interior of the housing into a supercharger chamber and an evacuation chamber on opposite sides of the piston. A supercharger chamber valve, positioned directly behind the reciprocating piston, controls the flow of liquified gas from a gas inlet into the supercharger chamber. A fixed piston, extending into the evacuation chamber, engages a cylindrical skirt carried by the reciprocating piston to form a high pressure chamber between the two pistons. Liquified case from the high pressure chamber is supplied to a gas outlet via a passageway in the fixed piston.

25 Claims, 3 Drawing Sheets

CRYOGENIC PUMP

BACKGROUND OF THE INVENTION

1. Field of the Invention

This present invention relates to mechanical pumps for pumping liquified gases and in particular to pumps adapted for pumping liquified gases in their saturated liquid state.

2. Description of the Prior Art

Cryogenic liquids such as hydrogen, oxygen, nitrogen, argon and liquified hydrocarbons i.e., methane or natural gas, are normally stored and transported in well-insulated low temperature containers to reduce the fluid evaporation losses. Pumps used to transfer such cryogenic fluids between containers or from one container to a point of use are generally mechanical pumps of the reciprocating type. Many conventional cryogenic pumps require the maintenance of a net positive suction head (NPSH), that is, a suction head above zero, to prevent the loss of prime of the pump and/or cavitation. Flow limitations generally result from the maintenance of an NPSH and it is therefore desirable to employ pumps that can operate with a negative suction head or an NPSH below zero.

U.S. Pat. No. 4,239,460 ("'460 Patent") describes a prior art pump which is designed to operate with a NPSH below zero. The '460 pump employs a reciprocating piston which divides a cylindrical housing into a suction and an evacuation chamber. A gas inlet port extends through the side of the housing for channeling liquified gas into the suction chamber. A fixed piston extends from an outlet end of the housing into the evacuation chamber. The fixed piston slides within a cylindrical skirt carried by the reciprocating piston to form a high pressure chamber. The pressurized liquified gas is supplied to an outlet through a passageway within the fixed piston. One way valves control the flow of liquified gas through the inlet, the several chambers and the outlet. While the design of the '460 pump is generally well suited for pumping cryogenic liquids it has several drawbacks. First, the placement of the suction inlet valve and associated suction passageways in the '460 pump limits the achievable ratio of the maximum to minimum volume of the suction chamber. This in turn limits the efficiency of the pump in operating as a compressor in transferring any vaporized liquid (gas) in the suction chamber into the high pressure chamber.

Second, the cool down time of the '460 pump is limited by a gas venting arrangement which allows the free flow of gas to the vent only when the moveable piston is in its forward position.

Third, the '460 pump requires a separate pressure relief valve to vent excess gas in the suction chamber.

There is a need for an improved cryogenic pump which is capable of operating with a sub-zero NPSH.

SUMMARY OF THE INVENTION

The above shortcomings are addressed by the present invention. An improved cryogenic pump for transferring liquified gases from a storage reservoir to a point of use or another reservoir in accordance with the present invention includes a reciprocating piston positioned in a first cylindrical housing for dividing the interior of the housing into a supercharger chamber and an evacuation chamber on opposite sides of the piston. At least one supercharger chamber inlet port extends through the cylindrical housing directly behind the reciprocating piston for channeling liquified gas from a liquified gas inlet into the supercharger chamber. A fixed piston is mounted in the housing and extends into the evacuation chamber. The fixed piston engages a skirt carried by the moveable piston to form a high pressure chamber between the moveable and fixed pistons, like the '460 pump. A liquified gas outlet extends through the fixed piston. One way valves control the flow of liquified gas into the several chambers and the outlet. Excess fluid from the supercharger chamber is vented back into the storage reservoir preferably through one or more restricted orifices, eliminating the need for a pressure relieve valve.

The pump may include a second or outer cylindrical housing in fluid communication with the liquified gas inlet and forming an enclosed spaced surrounding the supercharger and high pressure chambers for allowing liquified gas to flash to gas within the enclosed space to rapidly cool the pump during start-up.

The structure and operation of the present invention can best be understood by reference to the following description taken in conjunction with the accompanying drawings wherein like components in the several figures are designated with the same reference numerals.

DESCRIPTION OF THE PREFERRED EMBODIMENT

Figure 1:
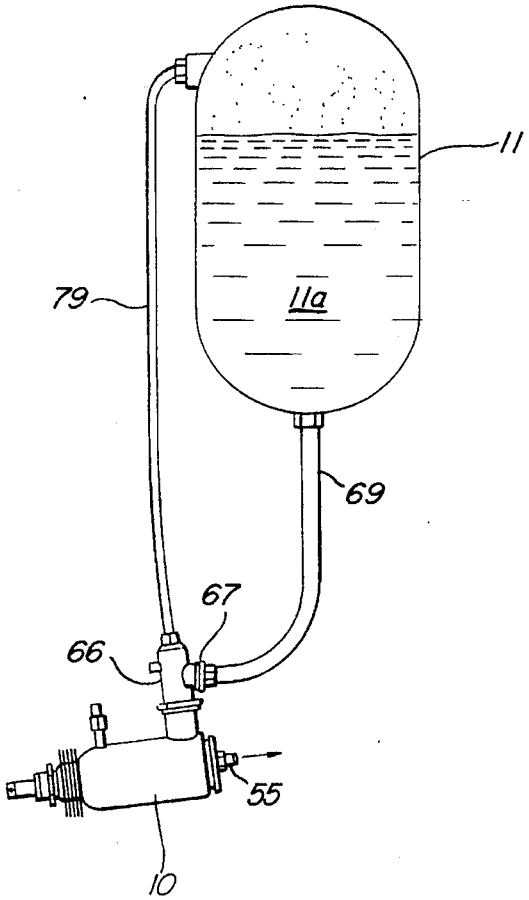
FIG. 1 is a diagrammatic view of a cryogenic pump in accordance with the present invention for transferring fluid therefrom.
Figure 3:
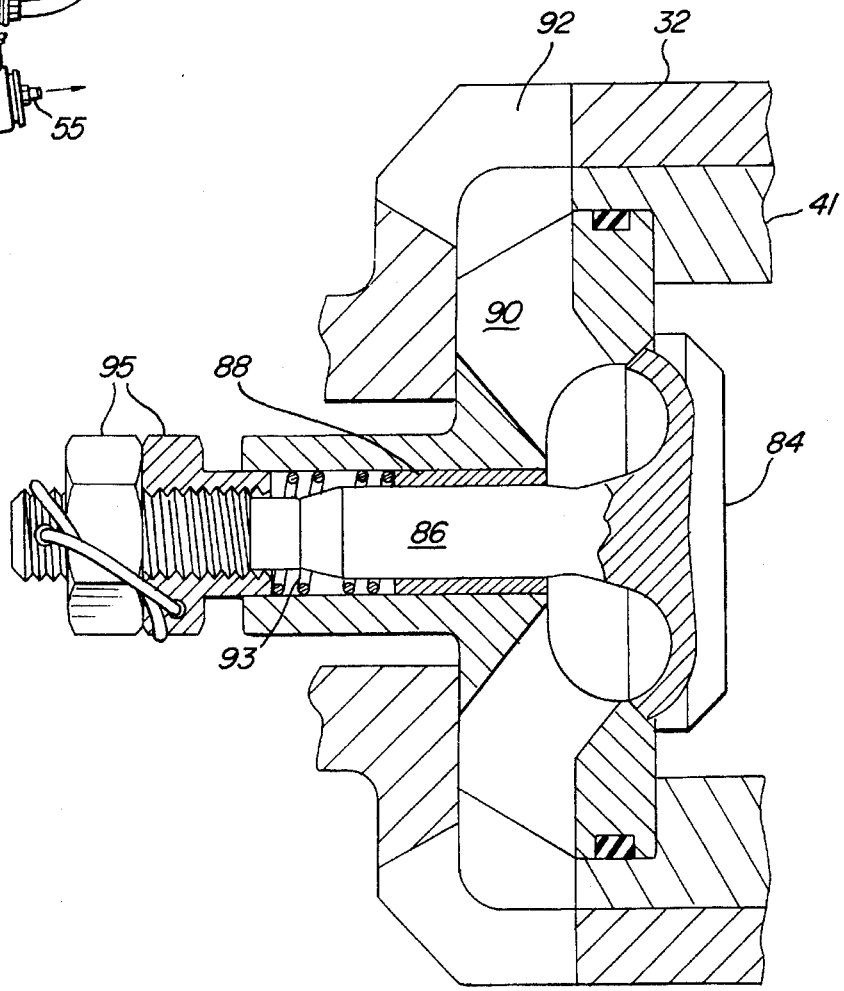
FIG. 3 is an enlarged cross-sectional view of the suction valve incorporated in the pump.
Figure 2:
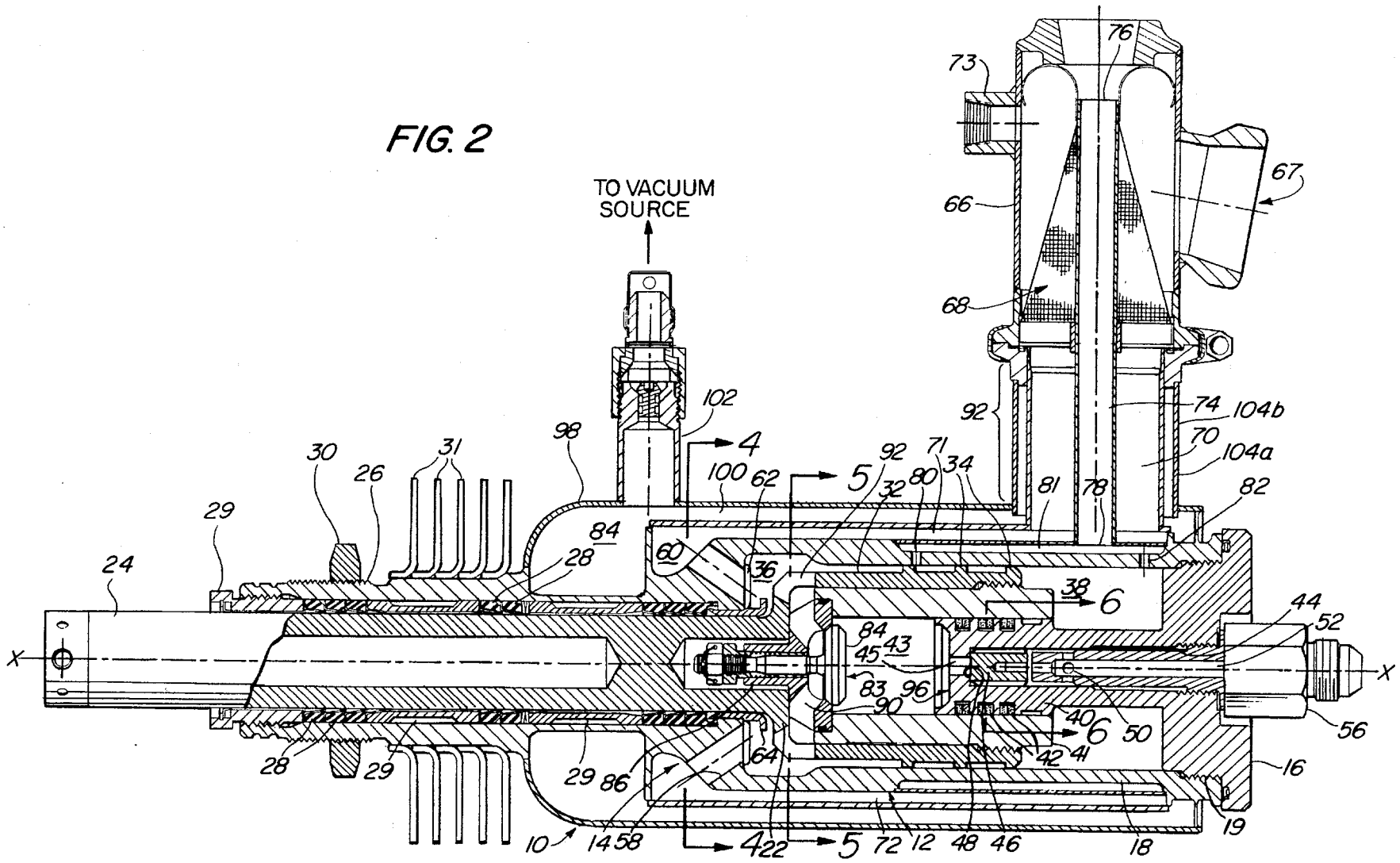
FIG. 2 is a cross-sectional view of the pump of FIG. 1 taken along the longitudinal axis thereof.
Figure 4:
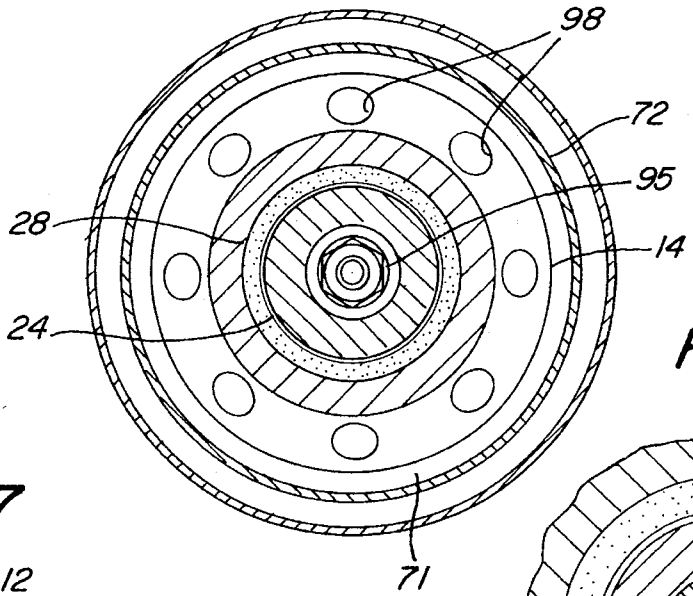
FIG. 4 is a cross-sectional view taken along lines 4—4 of FIG. 2.
Figure 6:
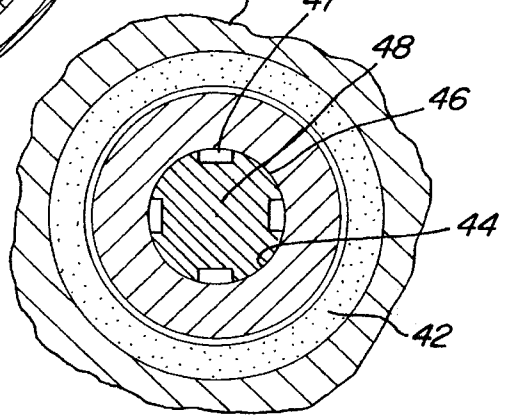
FIG. 6 is a cross-sectional view taken along lines 6—6 of FIG. 2.

Referring now to the drawings and in particular FIGS. 1 and 2, a liquified gas pump in accordance with the present invention is designated by the numeral 10. The pump is connected to a liquified gas-reservoir 11 for transferring liquified gas 11*a* therein to a designated destination as will be explained in more detail. The pump 10 includes a first or inner cylindrical housing 12 having an inlet end or section 14, a discharge (outlet) end or section 16 and a central section 18. The inlet section is formed integrally with the central section while the outlet section comprises a discharge head 16 threaded in place via threads 19, for example, to the central section 18.

A moveable piston 22 is mounted within the inner housing 12 for reciprocating movement therein along a longitudinal axis x—x. An actuating rod 24 formed integrally with the piston 22 extends through a rearwardly extending portion 26 of the inner housing 12. Shaft seals 28, positioned between the actuating rod 24 and to the inner cylindrical wall of the rear portion 26 of the housing 12 via sleeves 29, inhibit the egress of fluid along the rod 24. The rod 24 may be coupled to a suitable driving mechanism such as an electric motor and cam arrangement (not shown) for providing the reciprocating motion for the piston. A nut lock 30 on the rearward extension of the inner housing may be used to attach the housing to the driving mechanism. Fins 31 on the rearward extension 26 of the inner housing serve to conduct heat to the extension 26 and prevent frost build-up.

The reciprocating piston 22 carries a forwardly extending skirt 32 with outwardly extending integrally formed rings which engage the inner wall of the central section 18 of the housing 12. The piston 22 divides the interior of the housing 12 into a supercharger chamber 36 and an evacuation chamber 38.

A fixed piston 40 which may be formed integrally with the discharge head 16, extends into the evacuation chamber as shown. The fixed piston 40 includes piston rings 42 which engage the inner wall of a sleeve 41 carried by the skirt 32 to form a high pressure chamber 43 between the moveable and fixed pistons. Outlet or discharge bores 44 and extend through the fixed piston and discharge head. A poppet discharge valve 46 is slidably mounted within the upstream end of this bore 44 and is arranged to engage a valve seat 48 on the bottom of the bore 44 and prevent fluid from flowing through the discharge bore into high pressure chamber. When the poppet valve 46 slides forwardly (toward the discharge end) fluid may flow through bore 45 around the valve 46, through peripheral grooves 47 in the valve body and into cross bores 50 and longitudinal bore 52 of a discharge fitting 56 positioned within the bore 44. An outlet or discharge line 55 (FIG. 1) is connected to the discharge fitting 54 via fitting 56 for receiving the high pressure discharged liquified gas.

The inlet end 14 of the inner housing 12 includes a plurality of ports or passageways 58 which channel liquified gas from a precharge chamber 60, adjacent the inlet end 14 of the housing 12, into the supercharger chamber 36. The passageways 58 open into the supercharger chamber 36 directly behind the moveable piston 22 and more particularly the passageways 58 open into the supercharger chamber along a plane perpendicular to the longitudinal axis x—x. A supercharger valve, designated at 62, in the form of a planar disk, is moveable along the longitudinal axis from the closed position shown in FIG. 2 to an open position when it engages a retainer ring 64 secured to the inner housing as illustrated.

A liquified gas inlet conduit 66 is provided with a suction port 67 which is connected to the bottom of the reservoir 11 via a suction line 69 as shown. The liquified gas from the reservoir is channeled through a screen 68, a first annular passageway 70 in the conduit 66 and into a second annular passageway 70 in fluid communication with the precharge chamber 60 as shown.

The second annular passageway 71 is formed in the space between the inner housing 12 and an outer cylindrical housing 72. The liquified gas inlet conduit is also provided with an optional auxiliary gauge port 73 which may be closed when not in use.

A vent tube 74 extends concentrically within the inlet conduit 66 and has an outlet end 76 and an inlet end 78. Gas flowing through the outlet end 76 is directed back to the top of the reservoir 11 via a return line 79.

The inner cylindrical housing 12 includes a plurality of vent orifices 80 along the top of the central section. These vent orifices serve to vent excess fluid (liquid and/or gas) from the supercharger chamber 36 through passageway 81 to the inlet 78 of the vent tube 74 during the return stoke of the piston 22 as will be explained. The orifices 80 are sized to provide the required back pressure to fluid within the supercharger chamber to allow the return stroke of the piston 22 to fill the high pressure chamber while preventing damage to the pump by allowing excess fluid to escape. Such orifices eliminate the need for a pressure relief valve.

An evacuation chamber vent port 82 extends through the wall of the inner cylindrical housing to vent fluid from the evacuation chamber 38 into the vent tube via the passageway 81 during the forward stroke of the reciprocating piston 22 as will be explained in more detail.

Figure 5:
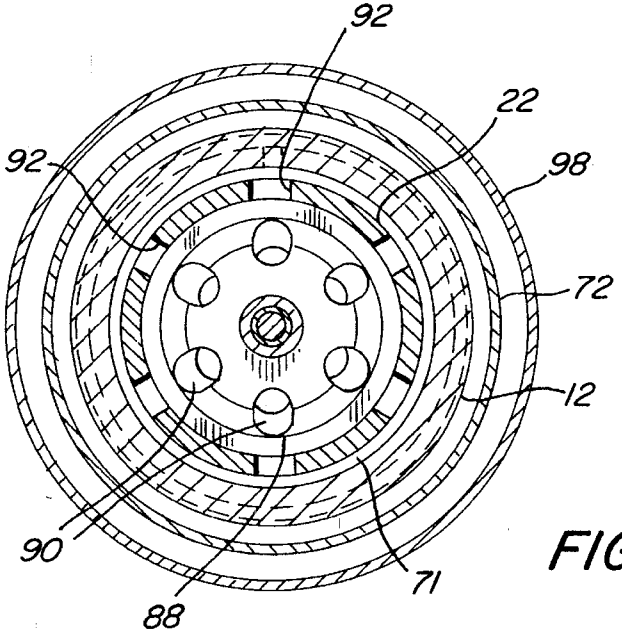
FIG. 5 is a cross-sectional view taken along lines 5—5 of FIG. 2.
Figure 7:
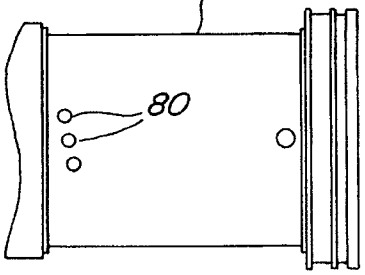
FIG. 7 is a partial top plan view of the inner cylindrical housing of the pump showing the position of the vent orifices.

A suction valve member 83, having a mushroomed-shaped head 84 and a stem 86, is slidably mounted in a bushing 88. The bushing 88 which may be made of a moly-teflon material with a steel backing (commonly referred to as a DU busing) is press fit into a valve body 87. The valve body 87 is secured in the piston 22 as shown. The valve body 87 includes ports 90 which in conjunction with passageways 92 in the rear portion of the moveable piston allows liquified gas from the supercharger chamber 36 to enter the high pressure chamber 43 when the suction valve 83 is open (i.e., moved to the right from the position shown in FIG. 2). The valve 83 is biased toward the closed position (as shown in FIG. 2) by a spring 93 which abuts the bushing 88 (shown in FIG. 5). The compressive force of the spring 39 may be adjusted by lock nuts 95 mounted on the threaded rear portion of the stem 86 as shown. It should be noted that the rear portion of the fixed piston 40 is formed with a cavity 96 which matches the mushroom head 84 of the suction valve to minimize the minimum volume in the high pressure chamber.

A vacuum (or third) housing 98 surrounds the second or outer housing 72 for inhibiting the flow of ambient heat into the interior of the pump. The annular space 100 between the second and third housing is connected to a vacuum source (not shown) through a valved fitting 102. The lower section 104 of the inlet conduit 66 includes inner and outer walls **104*a* and 104*b* forming an annular space therebetween which is in vacuum communication with the evacuated space 84. The housings, fittings and valves of the pump are preferably made of stainless steel while the rings 42** on the fixed piston may be made of teflon.

The pump is preferably mounted at a small angle to the horizontal as shown in FIG. 1 so that vapor will not accumulate in the pump but will rise to the top of the pump and be directed back to the reservoir via the vent line 79. During start-up liquified gas **11*a* from the reservoir 11 flows through the suction port and enters the enclosed annular passageway 71, between the inner and outer housings 12 and 72, and a portion thereof vaporizes in extracting heat from the internal components of the pump. The vapor passes back and up through the passageways 71 and 70 to the vent line 79 where it is returned to the top of the tank 11 above the liquid level therein. The enclosed annular passageway 71** serves to provide a quick cool down for the pump during start-up.

In operation the following actions occur during the forward travel or stroke of the reciprocating piston 22 (i.e., toward the discharge head):

(1) Liquified gas in the high pressure chamber 43 forces the poppet valve 46 away from its seat 48 and toward the discharge head (to the right in FIG. 2) thereby opening this valve. The liquified gas under pressure flows through the passageway 45 in the fixed piston 40), the peripheral channels 47 in the valve 46, through ports 50 in the discharge fitting 56 and then through the bore 52 to the outlet line 55. Pressure within the high pressure chamber maintains the suction valve 83 closed during this forward stroke of the reciprocating piston;

(2) The volume in the evacuation chamber 38 decreases during this forward movement of the piston 22 and a mixture of liquified gas and vapor within the evacuation chamber is vented through the vent port 82 into the vent tube 74; and (3) The volume in the supercharger chamber 36 increases as a result of the forward movement of the piston 22 creating a low pressure therein which moves the supercharger valve 62 forward against the retainer ring 64 and opens this valve. Liquified gas then flows into the supercharger chamber 36 until the piston 22 reaches the end of its forward travel. A portion of the liquified gas will vaporize within the supercharger chamber 36 due to the low pressure therein.

During the return stroke of the piston 22 the following actions occur:

(1) The pressure in the high pressure chamber 43 decreases allowing the high pressure of the discharge fluid in bore 52 acting on the rear face of the valve 46 to move this valve against its seat 48 to a closed position;

(2) The liquified gas and any vapor is compressed in the supercharger chamber 36 due to the decreasing volume therein. The increasing pressure liquifies any vaporized gas in the supercharger chamber and this higher pressure liquid forces the valve 83 toward the discharge head against the action of the spring 93 thereby allowing liquified gas to enter the high pressure chamber; and (3) The high pressure buildup in the supercharger chamber also closes the supercharger valve 62 by moving it towards the inlet end (to the left in FIG. 2). Since the supercharger chamber has a larger volume than the high pressure chamber, there may be excess liquified gas within the supercharger chamber. The excess liquid is vented through ports 80 to the vent tube 74 as explained previously.

It is noted that the passageways 58 and the supercharger valve 62 are located directly behind the piston 22 as not to interfere with an optimum position for the end of the return stroke of the piston 22. This feature minimizes the minimum volume of the supercharger chamber (within practical pressure limits) and ensures an above zero NPSH in the supercharger chamber at the end of the return stroke of the movable piston with a sub-zero NPSH in the precharge chamber 84. As a result the volume of gas in the fluid entering the high pressure chamber is minimized allowing the pump to operate efficiently with saturated fluids.

Other novel features include the vent orifices 80 which provide sufficient back pressure to allow the necessary pressure buildup within the supercharger chamber during the return stroke of the movable piston while venting excess liquid thereby eliminating the need for a pressure relief valve. Also, the vent port 82 allows gas to flow in and out of the evacuation chamber independently of the position of the reciprocating piston. In addition, the enclosed space 71, surrounding the supercharger and high pressure chambers, allows vaporized gas to remove heat from the internal pump components and provide a quick cool down of the pump during start-up.

There has thus been described an improved cryogenic pump for transferring liquified gases from a reservoir to a point of use or to another reservoir which provides several important advantages over prior art pumps. Various modifications of the pump will occur to persons skilled in the art without departing from the spirit and scope of the invention and described in the appended claims.

What is claimed is:

1. A cryogenic pump for liquified gases comprising:

a cylindrical housing having a longitudinal axis and an inlet section at one end and discharge section at the other end;

a moveable piston positioned in the cylindrical housing for reciprocating movement therein from the end of its forward stroke adjacent the outlet end of the housing to the end of the return stoke, adjacent the inlet end of the housing, the moveable piston dividing the interior of the cylindrical housing into a supercharger chamber and an evacuation chamber on opposite sides of the piston, the piston having a skirt extending into the evacuation chamber;

a liquified gas inlet;

at least one supercharger inlet port extending through the cylindrical housing in the inlet section thereof for channeling liquified gas from the liquified gas inlet into the supercharger chamber, the port being positioned behind the moveable piston whereby the position of the port does not interfere with an optimum position for the end of the return stroke of the moveable piston;

a supercharger chamber valve communicating with the supercharger inlet port for controlling the flow of liquified gas through the port;

a fixed piston mounted in the housing in sliding engagement with the moveable piston skirt to form a high pressure chamber between the moveable and fixed pistons;

a high pressure chamber suction valve disposed between the supercharger chamber and the high pressure chamber for controlling the flow of liquified gas into the high pressure chamber;

a high pressure outlet extending through the fixed piston and the discharge section; and a discharge valve positioned in the high pressure outlet for controlling the flow of liquified gas through the outlet.

2. The cryogenic pump of claim 1 wherein said at least one supercharger inlet port comprises a plurality of ports opening into the supercharger chamber substantially around a line that intersects the longitudinal axis of the pump.

3. The cryogenic pump of claim 2 wherein the ports open into the supercharger chamber substantially in a plane that intersects the longitudinal axis of the pump.

4. The cryogenic pump of claim 3 wherein the ports open into the supercharger chamber substantially in a plane perpendicular to the longitudinal axis.

5. The cryogenic pump of claim 3 wherein the supercharger valve comprises an annular disk positioned within the supercharger chamber and arranged to seal the ports when the pressure within the supercharger chamber exceeds the pressure in the liquified gas inlet and to unseal the ports when the pressure in the liquified gas inlet exceeds the pressure within the supercharger chamber.

6. The cryogenic pump of claim 5 further including a vent conduit and an excess fluid duct connecting the supercharger chamber to the vent conduit for venting excess fluid from the supercharger chamber.

7. The cryogenic pump of claim 6 further including an evacuation chamber duct connecting the evacuation chamber to the vent conduit.

8. The cryogenic pump of claim 6 wherein the suction valve includes a valve member having an elongated stem and a mushroom-shaped head, the valve member being slidably positioned within the moveable piston adjacent the inlet end of the cylindrical housing.

9. The cryogenic pump of claim 8 wherein the suction valve further includes a valve body secured to the moveable piston adjacent the inlet end of the cylindrical housing and wherein the stem of the valve member is slidably received in the valve body.

10. The cryogenic pump of claim 9 further including a spring coupled between the valve member and the valve body for biasing the valve member toward a closed position.

11. The cryogenic pump of claim 6 further including a second cylindrical housing enclosing a substantial portion of the first housing to form an enclosed annular space substantially surrounding the supercharger and high pressure chambers, the enclosed annular space between the first and second housings connecting the liquified gas inlet to the supercharger chamber valve, whereby liquified gas will flash to a gas within the annular space in removing heat from the pump to rapidly cool the pump during start up.

12. A cryogenic pump for liquified gases comprising:

a first cylindrical housing arranged symmetrically about a longitudinal axis and having an inner cylindrical wall;

a moveable piston positioned in the first cylindrical housing for sliding engagement with the inner wall of the first cylindrical housing along the longitudinal axis, the moveable piston dividing the interior of the first housing into a supercharger chamber and an evacuation chamber on opposite sides of the piston, the moveable piston having a skirt extending into the evacuation chamber, the skirt having an inner wall;

a liquified gas inlet;

a supercharger chamber valve connected between the supercharger chamber and the liquified gas inlet for admitting liquified gas into the supercharger chamber;

a fixed piston mounted in the housing in sliding engagement with the inner wall of the moveable piston skirt to form a high pressure chamber between the moveable and fixed pistons;

a high pressure suction chamber valve connected between the supercharger chamber and the high pressure chamber for controlling the flow of liquified gas into the high pressure chamber;

a high pressure outlet extending through the fixed piston;

a discharge valve positioned in the outlet for controlling the flow of liquified gas through the outlet;

a vent conduit;

an evacuation chamber duct connecting the evacuation chamber to the vent conduit for conducting fluid therebetween independently of the position of the moveable piston and;

an excess fluid duct connecting the supercharger chamber to the vent conduit for venting excess fluid from the supercharger chamber.

13. The cryogenic pump of claim 12 further including a second cylindrical housing enclosing a substantial portion of the first housing to form an enclosed annular space substantially surrounding the supercharger and high pressure chambers, the enclosed annular space between the first and second housings connecting the liquified gas inlet to the supercharger chamber valve, whereby liquified gas will flash to a gas within the annular space in removing heat from the pump to rapidly cool the pump during start up.

14. The cryogenic pump of claim 13 wherein the supercharger chamber valve is disposed along the longitudinal axis on the side of the moveable piston opposite the high pressure chamber.

15. The cryogenic pump of claim 14 wherein the first cylindrical housing has an inner wall and a plurality of ports in fluid communication with the annular space between the first and second housing, the ports opening into the supercharger chamber substantially along a plane that intersects the longitudinal axis of the pump and wherein the supercharger chamber valve comprises an annular disk positioned within the supercharger chamber and arranged to seal the ports when the pressure within the supercharger chamber exceeds the pressure in the liquified gas inlet and to unseal the ports when the pressure in the liquified gas inlet exceeds the pressure within the supercharger chamber.

16. The cryogenic pump of claim 15 wherein the vent conduit comprises a tube extending within the liquified gas inlet, whereby the liquified gas is conducted around the vent tube into the enclosed space between the first and second housings.

17. The cryogenic pump of claim 16 wherein the excess fluid duct includes at least one flow restricting orifice in the top of the first housing for regulating the maximum pressure within the supercharger chamber.

18. The cryogenic pump of claim 14 wherein the supercharger valve is disposed behind the moveable piston.

19. The cryogenic pump of claim 18 further including a third cylindrical housing substantially enclosing the second housing and forming an enclosed space therebetween and means for connecting the space between the second and third housings to a vacuum source.

20. The cryogenic pump of claim 19 wherein said at least one restrictive orifice comprises a plurality of orifices.

21. A cryogenic pump for transferring liquified gases from a liquified gas inlet to an outlet comprising:

a inner cylindrical housing arranged symmetrically about a longitudinal axis and having an inlet section at one end and a discharge section at the other end;

a moveable piston positioned in the inner cylinder for reciprocating movement therein, the moveable piston dividing the interior of the inner housing into a supercharger chamber and an evacuation chamber on opposite sides of the piston, the piston having a skirt extending into the evacuation chamber;

means for connecting the liquified gas inlet to the supercharger chamber;

a fixed piston mounted in the housing in contact with the moveable piston skirt forming a high pressure chamber between the moveable and fixed pistons;

an outlet passageway in the fixed piston in fluid communication with the pump outlet;

means for selectively connecting the supercharger chamber to the high pressure chamber;

means for selectively connecting the high pressure chamber to the outlet passageway in the fixed piston;

an outer cylindrical housing in fluid communication with the liquified gas inlet and enclosing at least a portion of the inner housing to form an enclosed space substantially surrounding the supercharger and high pressure chambers, whereby liquified gas from the liquified gas inlet will flash into a vapor in the enclosed annular space and extract heat from the pump when the gas inlet conduit is initially connected to a source of liquified gas; and means for venting vapor from the enclosed space.

22. The cryogenic pump of claim 21 further including a vent conduit and an excess fluid duct connecting the supercharger chamber to the vent conduit for venting excess fluid from the supercharger chamber.

23. The cryogenic pump of claim 22 further including an evacuation chamber duct connecting the evacuation chamber to the vent conduit.

24. The cryogenic pump of claim 23 further including a third cylindrical housing substantially enclosing the second housing and forming an enclosed space therebetween and means for connecting the space between the second and third housings to a vacuum source.

25. A cryogenic pump for liquified gases comprising:

a cylindrical housing having a longitudinal axis and an inlet section at one end and discharge section at the other end;

a moveable piston positioned in the cylindrical housing for reciprocating movement therein the moveable piston dividing the interior of the cylindrical housing into a supercharger chamber and an evacuation chamber on opposite sides of the piston, the piston having a skirt extending into the evacuation chamber;

a liquified gas inlet;

at least one supercharger inlet port extending through the cylindrical housing in the inlet section thereof for channeling liquified gas from the liquified gas inlet into the supercharger chamber, the port being positioned behind the moveable piston to minimize the minimum volume of the supercharger chamber;

a supercharger chamber valve communicating with a supercharger inlet port for controlling the flow of liquified gas through the port;

a fixed piston mounted in the housing in sliding engagement with the moveable piston skirt to form a high pressure chamber between the moveable and fixed pistons;

a high pressure chamber suction valve connected between the supercharger chamber and the high pressure chamber for controlling the flow of liquified gas into the high pressure chamber;

a high pressure outlet extending through the fixed piston and the discharge section; and a discharge valve positioned in the high pressure outlet for controlling the flow of liquified gas through the outlet;

a vent conduit;

an evacuation chamber duct connecting the evacuation chamber to the vent conduit for conducting fluid therebetween; and an excess fluid duct connecting the supercharger chamber to the vent conduit for venting excess fluid from the supercharger chamber.

* * * * *